US011268462B2

(12) United States Patent
Fujita

(10) Patent No.: US 11,268,462 B2
(45) Date of Patent: Mar. 8, 2022

(54) EVAPORATED FUEL TREATMENT APPARATUS

(71) Applicant: AISAN KOGYO KABUSHIKI KAISHA, Obu (JP)

(72) Inventor: Yuki Fujita, Gifu (JP)

(73) Assignee: AISAN KOGYO KABUSHIKI KAISHA, Obu (JP)

( * ) Notice: Subject to any disclaimer, the term of this patent is extended or adjusted under 35 U.S.C. 154(b) by 0 days.

(21) Appl. No.: 17/269,035

(22) PCT Filed: May 29, 2019

(86) PCT No.: PCT/JP2019/021332

§ 371 (c)(1),
(2) Date: Feb. 17, 2021

(87) PCT Pub. No.: WO2020/054139

PCT Pub. Date: Mar. 19, 2020

(65) Prior Publication Data

US 2021/0270196 A1 Sep. 2, 2021

(30) Foreign Application Priority Data

Sep. 13, 2018 (JP) ..... JP2018-171536

(51) Int. Cl.
*F02D 41/00* (2006.01)
*F02M 25/08* (2006.01)

(52) U.S. Cl.
CPC ..... *F02D 41/004* (2013.01); *F02M 25/089* (2013.01); *F02M 25/0836* (2013.01); *F02M 25/0854* (2013.01); *F02D 2200/503* (2013.01)

(58) Field of Classification Search
CPC ..... F02D 41/004; F02D 2200/503; F02M 25/0854; F02M 25/0836; F02M 25/089
See application file for complete search history.

(56) References Cited

U.S. PATENT DOCUMENTS 6,138,644 A 10/2000 Saruwatari et al.
6,257,209 B1 7/2001 Hyodo et al.
(Continued)

FOREIGN PATENT DOCUMENTS

JP H11-173220 A 6/1999
JP H11-303691 A 11/1999
(Continued)

OTHER PUBLICATIONS

Aug. 13, 2019 International Search Report issued in International Patent Application No. PCT/JP2019/021332.
(Continued)

*Primary Examiner* — Xiao En Mo
(74) *Attorney, Agent, or Firm* — Oliff PLC

(57) ABSTRACT

In this evaporated fuel treatment apparatus, there are set a purge condition that is a condition for performing purge control, a first pre purge condition that is met before the purge condition is met, and a second pre purge condition that is met between the purge condition and the first pre purge condition. A purge pump is driven at an idling speed lower than a rated speed to execute idle rotation when the first pre purge condition is met. The purge pump is driven at the rated speed to execute rated rotation when the second pre purge condition is met. A purge valve is opened while the rated rotation is performed when the purge condition is met.

20 Claims, 5 Drawing Sheets

(56) References Cited

U.S. PATENT DOCUMENTS

| | | | | |
|---|---|---|---|---|
| 2017/0089275 | A1* | 3/2017 | Ooiwa | F02M 25/089 |
| 2019/0345885 | A1 | 11/2019 | Asanuma | |

FOREIGN PATENT DOCUMENTS

| | | | |
|---|---|---|---|
| JP | 2017-67008 | A | 4/2017 |
| JP | 2018-76858 | A | 5/2018 |

OTHER PUBLICATIONS

Jun. 15, 2021 Office Action issued in Japanese Patent Application No. 2018-171536.

Mar. 9, 2021 International Preliminary Report on Patentability issued in International Patent Application No. PCT/JP2019/021332.

* cited by examiner

EVAPORATED FUEL TREATMENT APPARATUS

CROSS-REFERENCE TO RELATED APPLICATIONS

This is a US national phase application based on the PCT International Patent Application No. PCT/JP2019/021332 filed on May 29, 2019, and claiming the priority of Japanese Patent Application No. 2018-171536 filed on Sep. 13, 2018, the entire contents of which are herewith incorporated by reference.

TECHNICAL FIELD

The present disclosure relates to an evaporated fuel treatment apparatus for supplying evaporated fuel generated in a fuel tank to an internal combustion engine through an intake passage.

BACKGROUND ART

In an evaporated fuel treatment apparatus disclosed in Patent Document 1, there are set a purge condition for executing a purge treatment and a pre condition to be satisfied just before the purge condition is satisfied. When the pre condition is satisfied, a purge pump is started to operate at an idle rotation speed lower than a rated rotation speed. When the purge condition is then satisfied, a purge valve is opened and the purge pump is driven at a rated rotation speed.

RELATED ART DOCUMENTS

Patent Documents

Patent Document 1: Japanese unexamined patent application publication No. 2017-67008

SUMMARY OF INVENTION

Problems to be Solved by the Invention

In the evaporated fuel treatment apparatus disclosed in Patent Document 1, however, the purge pump is caused to gradually increase the rotation speed from the idle rotation speed to the rated rotation speed after satisfaction of the purge condition. Therefore, at the time point when the purge condition is met, the purge pump is not being driven at the rated rotation speed, so that a purge flow rate (i.e., a flow rate of purge gas to be introduced into the intake passage) may be insufficient.

The present disclosure has been made to address the above problems and has a purpose to provide an evaporated fuel treatment apparatus capable of supplying a sufficient purge flow rate at the time point when a purge condition is satisfied.

Means of Solving the Problems

To achieve the above-mentioned purpose, one aspect of the present disclosure provides an evaporated fuel treatment apparatus comprising: a canister configured to store evaporated fuel; a purge passage that is connected to an intake passage connected to an internal combustion engine and is connected to the canister; a purge pump provided in the purge passage; and a purge valve configured to open and close the purge passage, wherein the evaporated fuel treatment apparatus is configured to open the purge valve while driving the purge pump to perform a purge control to introduce purge gas containing the evaporated fuel from the canister to the intake passage through the purge passage, wherein when there are set a purge condition for performing the purge control, a first pre purge condition that is satisfied before the purge condition is satisfied, and a second pre purge condition that is satisfied between the purge condition and the first pre purge condition, the apparatus is configured such that: when the first pre purge condition is satisfied, the purge pump is driven at an idle rotation speed lower than a rated rotation speed to execute idle rotation; when the second pre purge condition is satisfied, the purge pump is driven at the rated rotation speed to execute rated rotation; and when the purge condition is satisfied, the purge valve is opened while the rated rotation is executed.

According to this configuration, the purge pump can be driven at the rated rotation speed at the time point when the purge condition is satisfied, so that a sufficient purge flow rate can be provided.

In the foregoing aspect, preferably, a time lag from when the second pre purge condition is satisfied to when the purge condition is satisfied is set to equal to or more than a time required to increase a rotation speed of the purge pump from the idle rotation speed up to the rated rotation speed.

According to this configuration, the purge pump can be further reliably driven at the rated rotation speed at the time point when the purge condition is satisfied, so that a sufficient purge flow rate can be ensured.

In the foregoing aspect, preferably, each condition of the first pre purge condition, the second pre purge condition, and the purge condition is set based on a state of charge of a battery mounted in a vehicle.

According to this configuration, observation of the state of charge of the battery enables to predict when the purge condition will be satisfied, and thus the first pre purge condition and the second pre purge condition can be set to appropriate timings. This configuration can therefore enhance the accuracy of controlling the purge pump to be driven at the rated rotation speed when the purge condition is satisfied.

In the foregoing aspect, preferably, each condition of the first pre purge condition, the second pre purge condition, and the purge condition is set based on running data of a vehicle.

According to this configuration, the satisfaction time of the purge condition can be predicted based on the running data of a vehicle, so that the first pre purge condition and the second pre purge condition can be set to appropriate timings. This configuration can therefore enhance the accuracy of controlling the purge pump to be driven at the rated rotation speed when the purge condition is satisfied.

In the foregoing aspect, preferably, the purge pump is stopped from driving at a time point when a time for executing the idle rotation exceeds a first predetermined time.

This configuration can eliminate the need to uselessly continue the rotation of the purge pump if a time period from when the first pre purge condition is satisfied until the second pre purge condition is satisfied is long.

In the foregoing aspect, preferably, wherein at a time point when a time for executing the rated rotation under a situation where the purge condition is not satisfied exceeds a second predetermined time, the rotation speed of the purge pump is decreased from the rated rotation speed to the idle rotation speed to execute the idle rotation, and then at a time point when a time for executing the idle rotation exceeds a third predetermined time, the purge pump is stopped from driving.

This configuration can eliminate the need to uselessly continue the rotation of the purge pump if a time period from when the second pre purge condition is satisfied until the purge condition is satisfied is long.

Effects of the Invention

According to the evaporated fuel treatment apparatus of the present disclosure, it is possible to ensure a sufficient purge flow rate at the time of satisfaction of a purge condition.

MODE FOR CARRYING OUT THE INVENTION

A detailed description of an embodiment of an evaporated fuel treatment apparatus of this disclosure will now be given referring to the accompanying drawings.

<Outline of Evaporated Fuel Treatment Apparatus>

The outline of an evaporated fuel treatment apparatus 1 in the present embodiment will be described below. This evaporated fuel treatment apparatus 1 is to be mounted in a vehicle, such as an automobile (e.g., an HV (a hybrid car) and a PHV (a plug-in hybrid car)) and so on.

Figure 1:
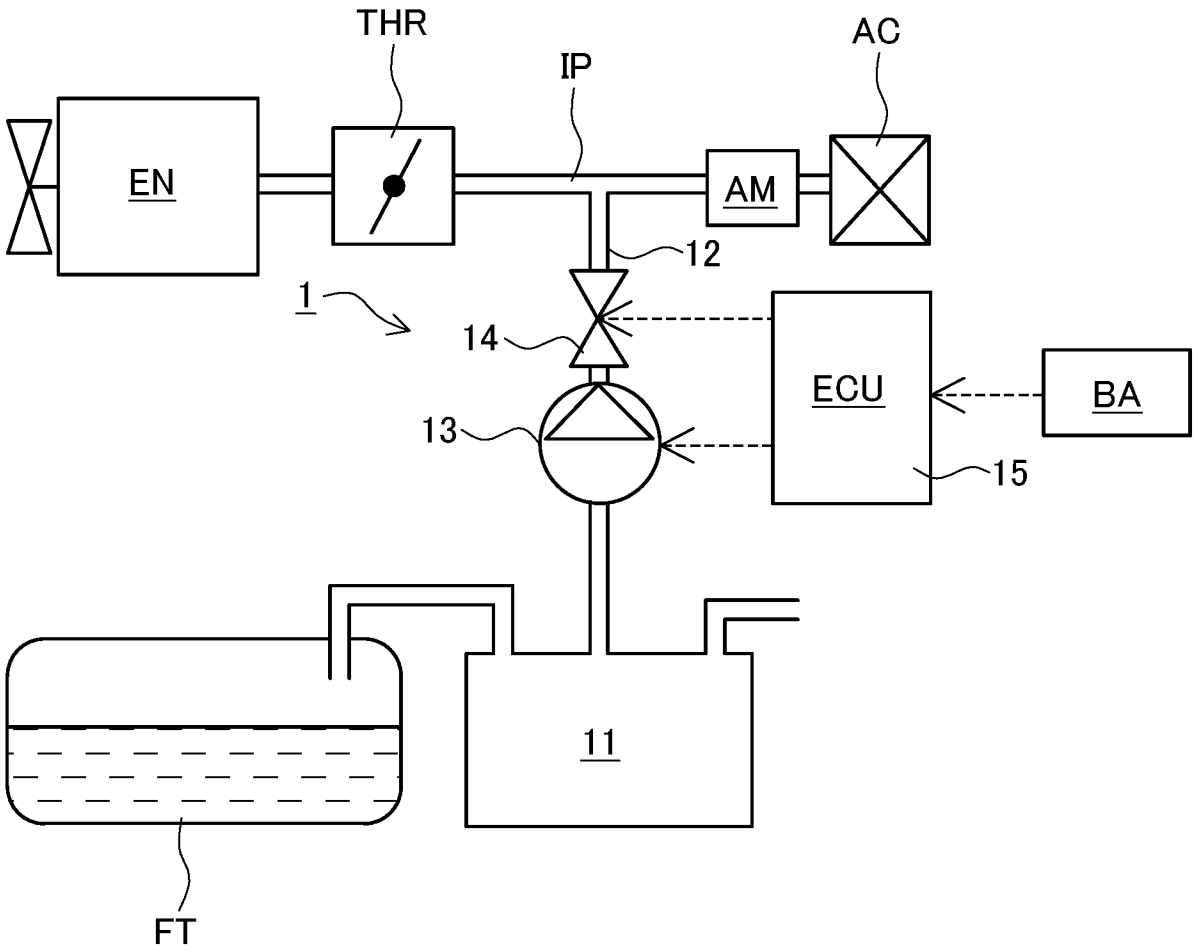
FIG. 1 is a schematic configuration view of an evaporated fuel treatment apparatus and its surroundings in a present embodiment.

Herein, as shown in FIG. 1, an engine EN (an internal combustion engine) to be mounted in a vehicle is connected to an intake passage IP for supplying air (intake air) to the engine. The intake passage IP is provided with a throttle valve THR (an intake passage opening and closing valve) for opening and closing the intake passage IP to control the flow rate of air allowed to flow in the engine EN (an inlet air flow rate).

An air cleaner AC is provided in the intake passage IP at a position upstream of the throttle valve THR (on an upstream side in a flowing direction of inlet air) to remove foreign matters from the air flowing in the intake passage IP. When the throttle valve THR is opened, accordingly, air having passed through the air cleaner AC is allowed to flow through the intake passage IP toward the engine EN.

Further, an air flow meter AM for detecting the flow rate of air flowing to the engine EN (the inlet air flow rate) is provided near the air cleaner AC in the intake passage IP, that is, at a position upstream of a connection point of the intake passage IP with a purge passage 12 which will be mentioned later.

The evaporated fuel treatment apparatus 1 in the present embodiment is an apparatus for supplying evaporated fuel generated in a fuel tank FT to the engine EN through the intake passage IP. The evaporated fuel treatment apparatus 1 includes a canister 11, the purge passage 12, a purge pump 13, a purge valve 14, an ECU (a control unit) 15, and others, as shown in FIG. 1.

The canister 1 is connected to the fuel tank FT and configured to store evaporated fuel that flows therein from the fuel tank FT.

One end of the purge passage 12 is connected to the canister 11. Thus, purge gas in the canister 11 (i.e., gas that contains evaporated fuel) flows in the purge passage 12. The other end of the purge passage 12 is connected to the intake passage IP at a position on a side close to the air cleaner AC (i.e., on an upstream side) relative to the throttle valve THR. Thus, the purge gas in the purge passage 12 is introduced into the intake passage IP. The other end of the purge passage 12 may be connected to the intake passage IP at a position on another side close to the engine EN (i.e., on a downstream side) relative to the throttle valve THR.

The purge pump 13 is provided in the purge passage 12. The purge pump 13 is configured to feed the purge gas into the purge passage 12, so that the purge gas fed to the purge passage 12 is then supplied to the intake passage IP.

The purge valve 14 is provided in the purge passage 12 at a position downstream of the purge pump 13 (on a downstream side in a flowing direction of the purge gas), that is, at a position between the purge pump 13 and the intake passage IP. When the purge valve 14 is closed (i.e., in a valve-closed state), the purge gas in the purge passage 12 is blocked by the purge valve 14 from flowing toward the intake passage IP. In contrast, when the purge valve 14 is opened (i.e., in a valve-open state), the purge gas is allowed to flow to the intake passage IP.

The ECU 15 is mounted in a vehicle and provided with memories, such as a CPU, a ROM, and a RAM. This ECU 15 is configured to control the engine EN, the throttle valve THR, and others according to programs stored in advance in the memories. In the present embodiment, the ECU 15 is configured to control the evaporated fuel treatment apparatus 1, for example, the purge pump 13 and the purge valve 14.

In the evaporated fuel treatment apparatus 1 configured as above, when a purge condition is satisfied during operation of the engine EN, the ECU 15 executes a purge control by opening the purge valve 14 while driving the purge pump 13. This "purge control" is a control to introduce purge gas from the canister 11 into the intake passage IP through the purge passage 12.

While the purge control is being executed, the engine EN is supplied with air drawn into the intake passage IP, fuel injected from the fuel tank FT through an injector (not shown), and purge gas (the gas containing the evaporated fuel) supplied to the intake passage IP by the purge control. The ECU 15 adjusts the injection time of the injector and the opening degree of the purge valve 14 to adjust an air-fuel ratio (A/F) of the engine EN to an optimal air-fuel ratio (e.g., an ideal air-fuel ratio).

In the present embodiment, as shown in FIG. 1, the ECU 15 can receive a signal from a battery BA installed in a vehicle. Herein, the battery BA is a secondary battery installed in for example an HV or a PHV.

<Pre-Control to be Executed Prior to the Purge Control>

For the HV, PHV, and the like, it is unnecessary to perform the purge control during intermittent stop (i.e., while only a motor (not shown) is being driven and the engine EN is forcibly stopped). In this period, therefore, it is conceivable to hold the purge pump 13 in a stopped state in light of improvement of fuel efficiency. However, when the purge pump 13 is activated from the stopped state, its responsivity may deteriorate. Specifically, after the intermittent stop is terminated and the engine EN starts to operate, even when the purge condition is met, the purge pump 13 could not be driven immediately at a rated rotation speed, so that a sufficient purge flow rate may not be provided. Herein, the "purge condition" is a condition for performing the purge control. The "rated rotation speed" is a rotation speed to produce a rated output (maximum performance under a designated condition). The "purge flow rate" is a flow rate of purge gas to be introduced into the intake passage IP.

In order to drive the purge pump 13 at a rated rotation speed at the time of satisfaction of the purge condition to provide a sufficient purge flow rate, therefore, the evaporated fuel treatment apparatus 1 in the present embodiment is configured to execute pre-control prior to the purge control. This pre-control will be described below.

In the present embodiment, the ECU 15 is configured to perform pre-driving to drive the purge pump 13 in advance of the purge control according to a state of charge of the battery BA (State of Charge (SOC), which is a rate of an electric charge quantity to an electric capacitance).

Figure 2:
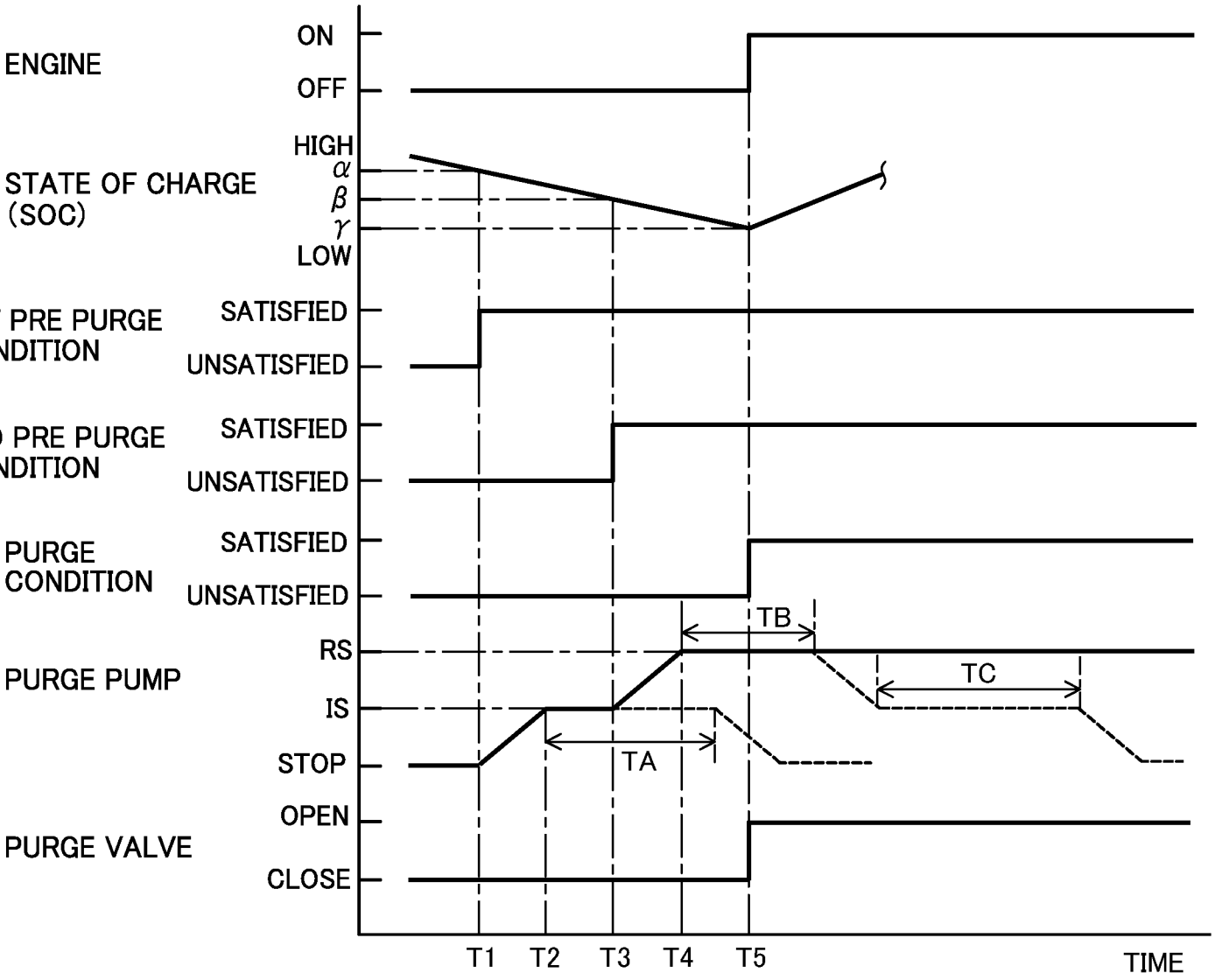
FIG. 2 shows one example of a time chart for control to be performed in the present embodiment.

To be specific, as shown in FIG. 2, when the state of charge (hereinafter, simply referred to as an SOC) of the battery BA decreases to a predetermined value α (e.g., 15%) or less at time T1 before the purge condition is satisfied, a first pre purge condition is met and thus the ECU 15 activates the purge pump 13 from the stopped state.

The ECU 15 further controls the purge pump 13 so that the rotation speed of the purge pump 13 reaches an idle rotation speed IS (e.g., 10000 rpm) at time T2. This idle rotation speed IS is a rotation speed lower than a rated rotation speed RS (e.g., 20000 rpm). The idle rotation speed IS is defined in consideration of the time required to increase up to the rated rotation speed RS and the electric consumption of the purge pump 13.

As above, when the first pre purge condition is satisfied prior to satisfaction of the purge condition, the ECU 15 performs idle rotation of the purge pump 13 to be driven at the idle rotation speed IS lower than the rated rotation speed RS.

When the SOC further decreases to a predetermined value β (e.g., 10%) smaller than the predetermined value α at time T3 before satisfaction of the purge condition but after satisfaction of the first pre purge condition, a second pre purge condition is met and thus the ECU 15 increases the rotation speed of the purge pump 13 from the idle rotation speed IS. The ECU 15 controls the purge pump 13 so that the rotation speed of the purge pump 13 reaches the rated rotation speed RS at time T4.

As above, when the second pre purge condition is satisfied between the purge condition and the first pre purge condition, the ECU 15 performs rated rotation of the purge pump 13 to be driven at the rated rotation speed RS.

When the SOC subsequently decreases to a predetermined value γ (e.g., 5%) smaller than the predetermined value β at time T5, the purge condition is met and thus the ECU 15 activates the engine EN and also opens the purge valve 14 to execute the purge control. At that time, the ECU 15 may perform an opening/closing control (a duty control) of the purge valve 14.

In the present embodiment, since the rotation speed of the purge pump 13 reaches the rated rotation speed RS at time T4, the rotation speed of the purge pump 13 at time T5 at which the purge condition is met has been already the rated rotation speed RS. Accordingly, at the time of satisfaction of the purge condition, the purge pump 13 can be driven at the rated rotation speed RS, so that a sufficient purge flow rate can be provided.

At the time of satisfaction of the purge condition, as described above, the ECU 15 opens the purge valve 14 while executing the rated rotation.

In the present embodiment, as described above, each of the first pre purge condition, the second pre purge condition, and the purge condition is set based on the SOC of the battery BA installed in a vehicle.

In the present embodiment, furthermore, by observing the SOC, it is possible to predict when the purge condition will be satisfied. Thus, the rotation speed of the purge pump 13 can be adjusted to the rated rotation speed RS in advance at time T4 prior to satisfaction of the purge condition, and the purge pump 13 can be reliably driven at the rated rotation speed RS at time T5 at which the purge condition is satisfied.

After the SOC becomes the predetermined value α or less, there may be some cases where the SOC does not immediately decrease to (does not immediately become as small as) the predetermined value β or the predetermined value γ. In such cases, the purge pump 13 may be controlled to decrease the rotation speed or may be stopped after a lapse of a predetermined time.

To be concrete, as indicated by a broken line in FIG. 2, the ECU 15 may be configured to decrease the rotation speed of the purge pump 13 from the idle rotation speed IS at the time point when the time for executing the idle rotation exceeds a predetermined time TA (a first predetermined time) and then stop driving of the purge pump 13. The "time for executing the idle rotation" represents a period of time during which the idle rotation of the purge pump 13 is continued from time T2 at which the idle rotation is started.

Furthermore, the ECU 15 may be configured to decrease the rotation speed of the purge pump 13 from the rated rotation speed RS to the idle rotation speed IS at the time point when a time for executing the rated rotation under the situation where the purge condition is not satisfied exceeds a predetermined time TB (a second predetermined time), thereby executing the idle rotation of the purge pump 13, as shown in FIG. 2. The "time for executing the rated rotation under the situation where the purge condition is not satisfied" represents a period of time during which the rated rotation is continued under the situation where the purge condition remains unsatisfied from time T4 at which the rated rotation of the purge pump 13 is started. The ECU 15 may also be configured to subsequently stop driving of the purge pump 13 at the time point when the time for executing the idle rotation exceeds a predetermined time TC (a third predetermined time).

As other variations, the ECU 15 may be configured to perform pre-driving of the purge pump 13 to preliminarily drive the purge pump 13 prior to execution of the purge control according to running data of a vehicle. This running data of a vehicle may include for example data of past idle times (intermittent stop times) stored in the memory region of the ECU 15. Therefore, after the intermittent stop time exceeds a predetermined time (e.g., an average time of the intermittent stop times calculated by learning of the running data), the pre-driving is performed.

Operations and Effects of the Present Embodiment

In the evaporated fuel treatment apparatus 1 in the present embodiment described above, when the first pre purge condition is satisfied, the ECU 15 executes the idle rotation to drive the purge pump 13 at the idle rotation speed IS.

When the second pre purge condition is then satisfied, the ECU 15 performs the rated rotation to drive the purge pump 13 at the rated rotation speed RS. When the purge condition is satisfied, thereafter, the ECU 15 opens the purge valve 14 while executing the rated rotation to drive the purge pump 13 at the rated rotation speed RS.

Accordingly, the purge pump 13 can be driven at the rated rotation speed RS at the time point when the purge condition is satisfied, so that a sufficient purge flow rate can be supplied.

Further, a time lag from the satisfaction of the second pre purge condition to the satisfaction of the purge condition is set to equal to or longer than the time required to increase the rotation speed of the purge pump 13 from the idle rotation speed IS to the rated rotation speed RS.

This configuration can further reliably drive the purge pump 13 at the rated rotation speed RS at the time point when the purge condition is satisfied, so that a sufficient purge flow rate can be supplied.

Each of the first pre purge condition, the second pre purge condition, and the purge condition is set based on the SOC.

As above, observing the SOC enables to predict when the purge condition will be satisfied, and thus the first pre purge condition and the second pre purge condition can be set to appropriate timings. This configuration can therefore enhance the accuracy of controlling the purge pump 13 to be driven at the rated rotation speed RS at the time of satisfaction of the purge condition.

As an alternative, each of the first pre purge condition, the second pre purge condition, and the purge condition may be set based on the running data of a vehicle.

Since it is possible to predict when the purge condition will be satisfied based on the past running data of a vehicle as described above, the first pre purge condition and the second pre purge condition can be set to appropriate timings. This configuration can therefore enhance the accuracy of controlling the purge pump 13 to be driven at the rated rotation speed RS at the time of satisfaction of the purge condition. As an alternative, each of the first pre purge condition, the second pre purge condition, and the purge condition may be set based on both the SOC and the running data of a vehicle.

The ECU 15 may be configured to stop driving of the purge pump 13 at the time point when the time for executing the idle rotation exceeds the predetermined time TA.

This configuration can eliminate the need to uselessly continue the rotation of the purge pump if the time period from when the first pre purge condition is satisfied until the second pre purge condition is satisfied is long.

Further, at the time point when the time for executing the rated rotation under the situation where the purge condition is not satisfied exceeds the predetermined time TB, the ECU 15 may be configured to decrease the rotation speed of the purge pump 13 from the rated rotation speed RS to the idle rotation speed IS to perform the idle rotation.

This configuration can eliminate the need to uselessly continue the rotation of the purge pump if the time period from when the second pre purge condition is satisfied until the purge condition is satisfied is long.

Figure 3:
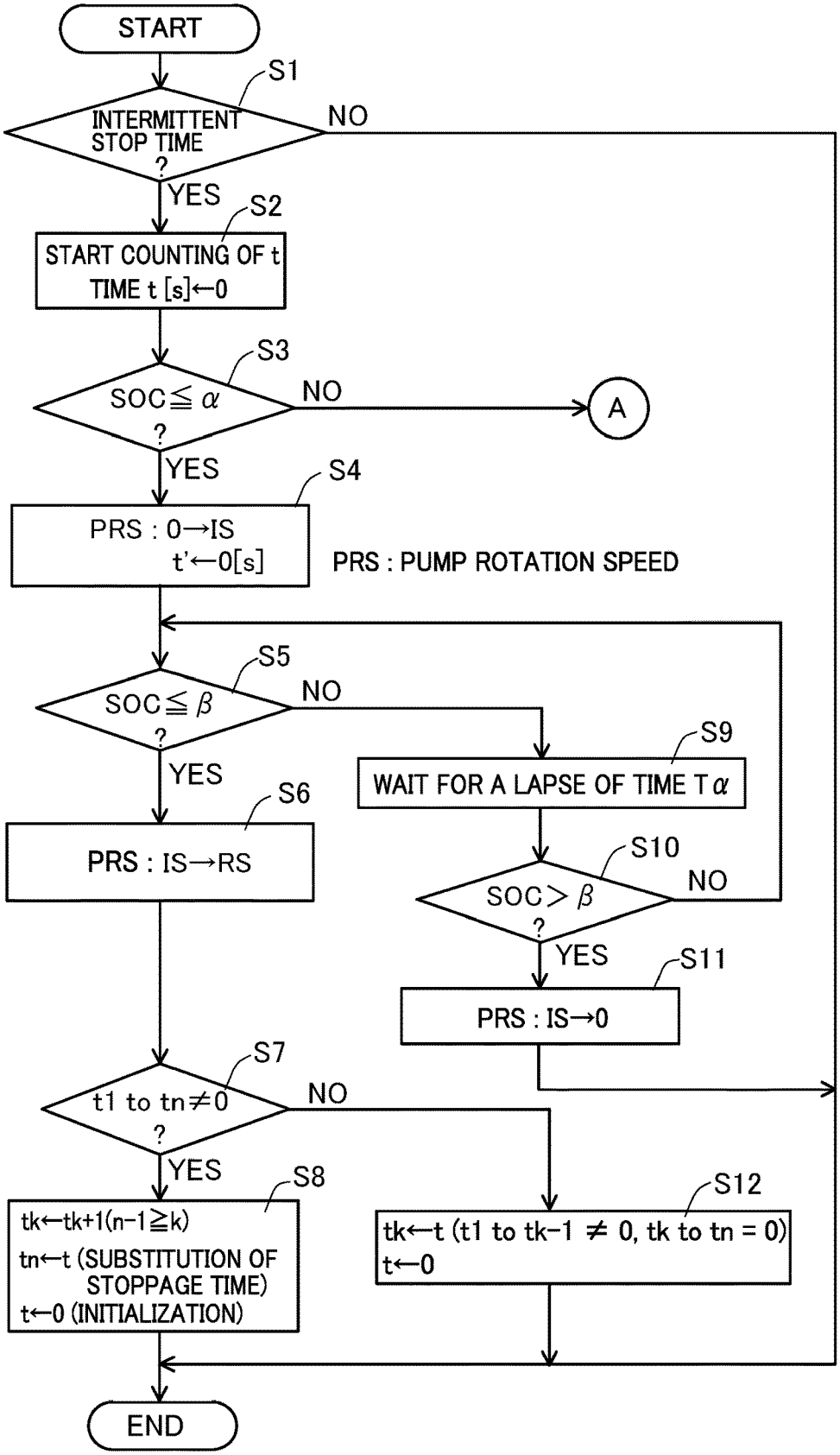
FIG. 3 shows one example of a flow chart for control to be performed in the present embodiment.
Figure 4:
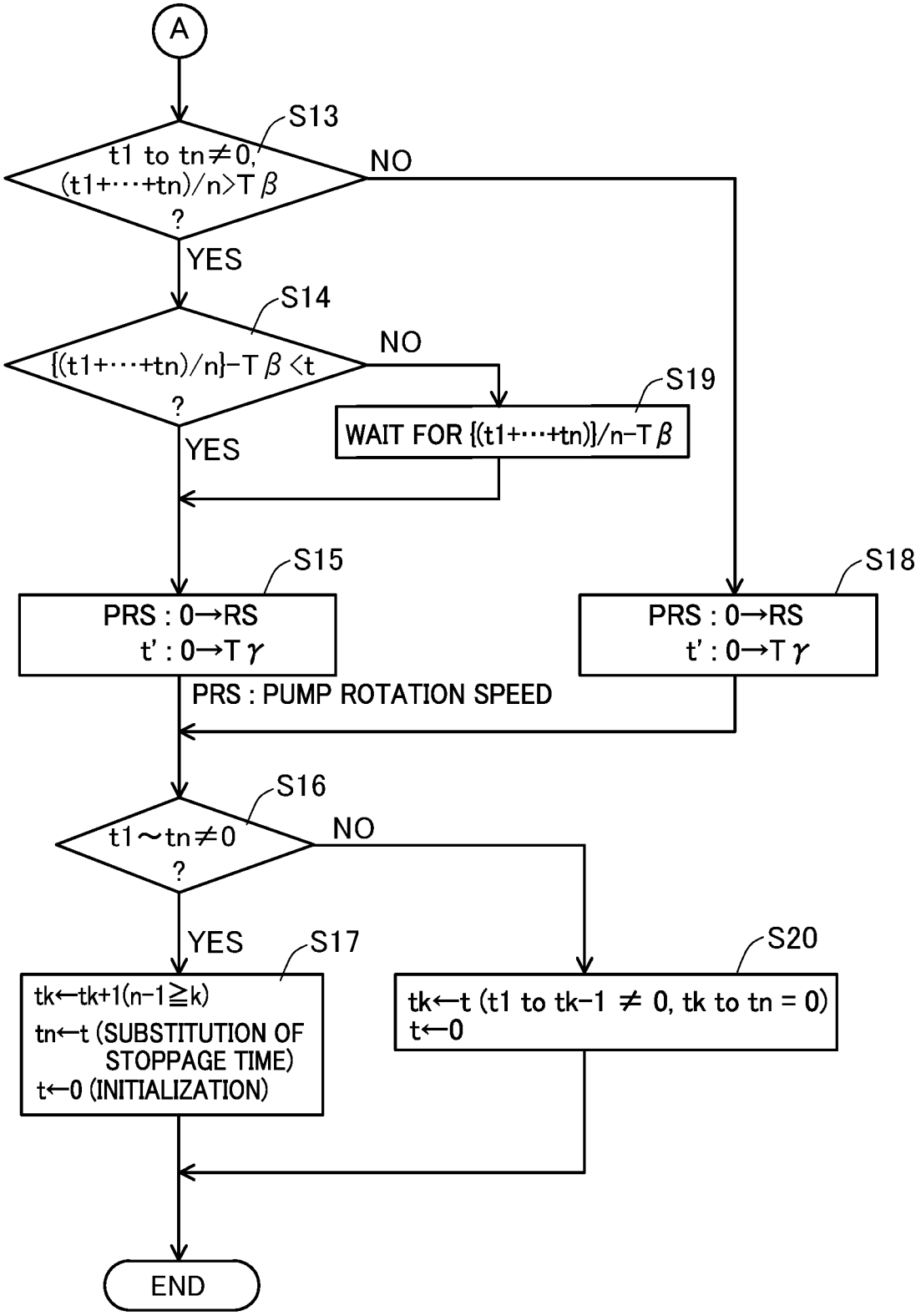
FIG. 4 shows one example of a flow chart for control to be performed in the present embodiment.

One Example of a Flowchart of Control to be Executed in the Present Embodiment In one example of a flowchart of the control to be executed in the present embodiment, the pre-control may be performed prior to the purge control based on flowcharts in FIGS. 3 and 4. In the flowcharts in FIGS. 3 and 4, the ECU 15 performs the control based on the state of charge (SOC) of a battery BA and the running data of a vehicle (i.e., data of past idle times (intermittent stop times) stored in the memory region of the ECU 15).

FIG. 3 will be described below. If the vehicle (HV, PHV, etc.) is in an intermittent stop state (step S1: YES), the ECU 15 sets the time t to 0 and further starts counting a time t (step S2) as shown in FIG. 3.

The ECU 15 then determines whether or not the SOC is equal to or less than the predetermined value $\alpha$ (e.g., 15%) (step S3).

When it is determined that the SOC is the predetermined value $\alpha$ or less in step S3 (step S3: YES), the ECU 15 controls the rotation speed of the purge pump 13 (a pump rotation speed) to increase from 0 to the idle rotation speed IS (e.g., 10000 rpm) and further sets a time t' to 0 (step 4).

In contrast, when it is determined that the SOC is larger than the predetermined value $\alpha$ (step S3: NO), the after-mentioned control based on the flowchart in FIG. 4 is executed.

After performing the processing in step S4 as above, the ECU 15 then determines whether or not the SOC is equal to or less than the predetermined value $\beta$ (e.g., 10%) (step S5).

When it is determined that the SOC is the predetermined value $\beta$ or less in step S5 (step S5: YES), the ECU 15 controls the rotation speed of the purge pump 13 to increase from the idle rotation speed IS to the rated rotation speed RS (e.g., 20000 rpm) (step S6).

The ECU 15 subsequently determines whether or not the condition:

t1 to tn≠0, that is, whether or not data (of past idle times) has been written in all the memory regions (provided in the ECU 15) that store the past idle times (the intermittent stop times) (step S7). It is to be noted that n is an arbitral integer number that is equal to or larger than 2.

When it is determined that the condition: t1 to tn≠0 is satisfied in step S7 (step S7: YES), the ECU 15 substitutes a value of a memory region tk+1 into a memory region tk, substitutes a time t (the intermittent stop time, the stoppage time, or the time counted from step S2) into a memory region tn, and initializes the time t to 0 (step S8). It is to be noted that k is an integer number that is equal to or larger than 2, but equal to or less than (n−1).

When it is determined that the SOC is larger than the predetermined value $\beta$ in step S5 (step S5: NO), the ECU 15 waits for a lapse of a predetermined time T$\alpha$ (e.g., 20 s) (step S9). After a lapse of the predetermined time T$\alpha$, when the SOC is determined to be equal to or less than the predetermined value $\beta$ (step S10: NO), the ECU 15 returns the processing to step S5. In contrast, when the SOC is determined to remain larger than the predetermined value $\beta$ (step S10: YES), the ECU 15 controls the rotation speed of the purge pump 13 to decrease from the idle rotation speed IS to 0 (step S11). In steps S9 to S11, as mentioned above, the purge pump 13 is stopped from driving when the SOC remains larger than the predetermined value $\beta$ for the predetermined time T$\alpha$ or more.

When it is determined in step S7 that the condition: t1 to tn≠0 is not met (step S7: NO), the ECU 15 substitutes the time t into the memory region tk and initializes the time t to 0 (step S12). This indicates that the data on the past idle times are stored in the memory region t1 to the memory region tk−1 (the memory region t1 to the memory region tk−1≠0), while the data on the past idle times are not stored yet in the memory region tk to the memory region tn (the memory region tk to the memory region tn=0).

FIG. 4 will be described below. When it is determined in step S3 that the SOC is larger than the predetermined value α (step S3: NO) as described above, the ECU 15 performs the control based on the flowchart shown in FIG. 4.

As shown in FIG. 4, the ECU 15 first determines whether or not the condition that (i) t1 to tn≠0 and (ii) the time expressed by {(t1+ . . . +tn)/n} (i.e., an average time of the past idle times) exceeds the predetermined time Tβ (e.g., 15 s) is satisfied (step S13). Specifically, in step S13, the ECU 15 determines whether or not data has been written in all the memory regions that store the past idle times, and, the average time of the past idle times stored in the memory regions exceeds the predetermined time Tβ.

When the condition in step S13 is satisfied (step 13: YES), the ECU 15 determines whether or not the time t exceeds the time expressed by [{(t1+ . . . +tn)/n}−predetermined time Tβ] (step S14). Specifically, the ECU 15 determines whether or not the time t approaches the average time ((t1+ . . . +tn)/n) of the past idle times.

The predetermined time Tβ is set as a time sufficiently longer than the time (a predetermined time Tγ which will be mentioned later) required to increase the rotation speed of the purge pump 13 from 0 to the rated rotation speed RS.

When the time t exceeds the time expressed by [{(t1+ . . . +tn)/n}−predetermined time Tβ] (step S14: YES), the ECU 15 controls the rotation speed of the purge pump 13 to increase from 0 to the rated rotation speed RS and further changes the time t' from 0 to the predetermined time Tγ (e.g., 10 s) (step S15). When the time t exceeds the time expressed by [{(t1+ . . . +tn)/n}− predetermined time Tβ], that is, when the time t approaches the average time ((t1+ . . . +tn)/n) of the past idle times, the ECU 15 starts to drive the purge pump 13 to rotate. The ECU 15 further increase the rotation speed of the purge pump 13 at once from 0 to the rated rotation speed RS for the predetermined time Tγ (a shorter time than the predetermined time Tβ) corresponding to the time t' elapsed from the start of driving the purge pump 13.

In steps S16, S17, and S20, the ECU 15 performs the same controls as the aforementioned controls in steps S7, S8, and S12 respectively. When the condition in step S13 is not satisfied (step S13: NO), the ECU 15 further executes the same control as the aforementioned control in step S15.

When the time t does not exceed the time expressed by [{(t1+ . . . +tn)/n}−predetermined time Tβ] (step S14: NO) in step S14, the ECU 15 waits until the time t exceeds the time expressed by [{(t1+ . . . +tn)/n}−predetermined time Tβ] (step S19) and then executes the control in step S15.

Figure 5:
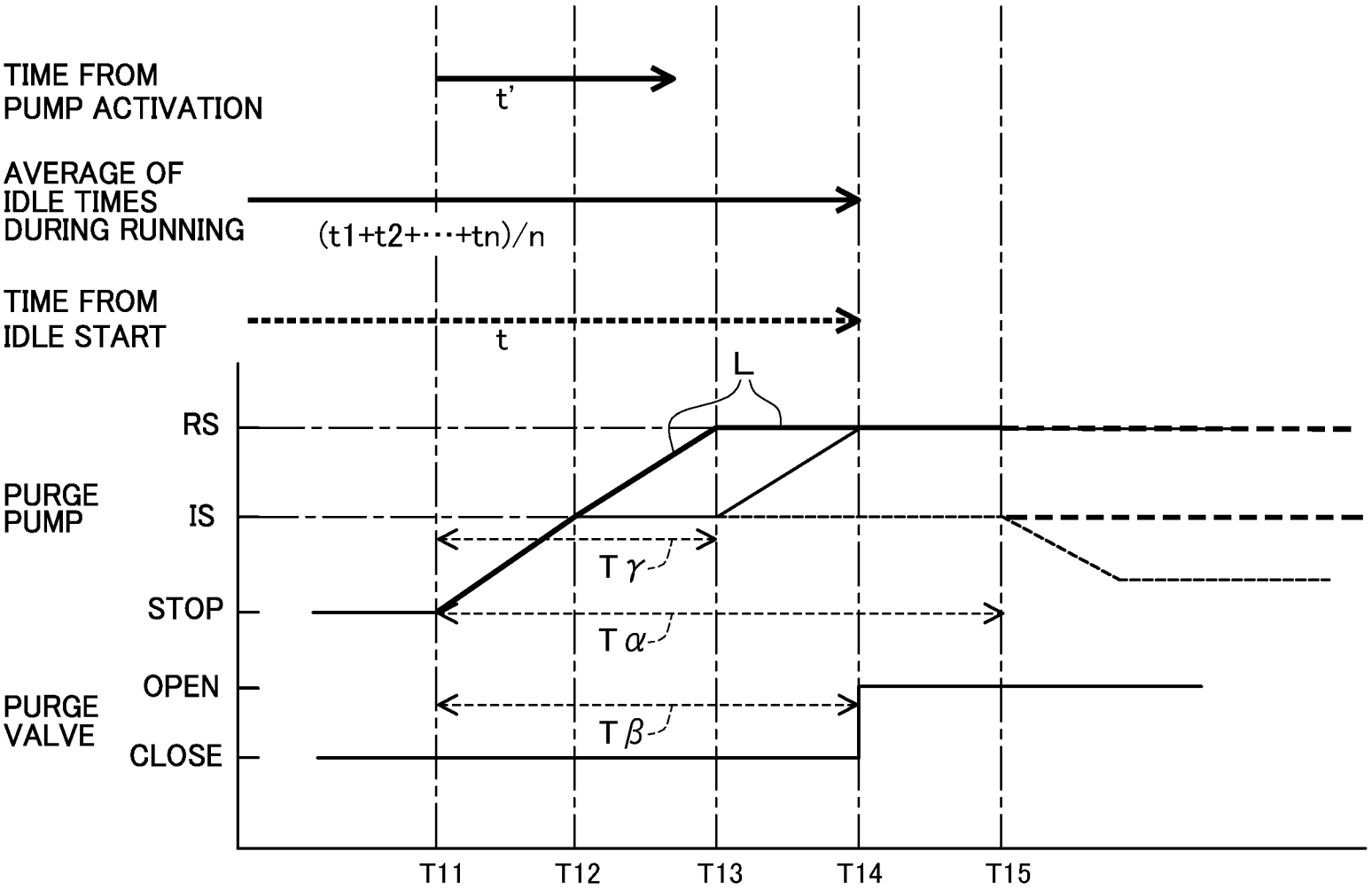
FIG. 5 is shows one example of a time chart for the control performed based on the flow charts shown in FIGS. 3 and 4.

By execution of the control based on the foregoing flowcharts, for example, the control shown in a time chart in FIG. 5 is performed. Specifically, when the SOC is sufficient, the ECU 15 determines the start time of driving the purge pump 13 based on the time t (the time counted from step S2 in FIG. 3) by taking into consideration the average time of the past idle times. After this determination of the start time of driving the purge pump 13, when the time t reaches a time (time T11), earlier by a predetermined time Tβ than the average time of the past idle times, the rotation speed of the purge pump 13 is caused to increase at once from 0 to the rated rotation speed RS (times T11 to T13, the predetermined time Tγ) as indicated with a thick line L in FIG. 5.

The foregoing embodiments are mere examples and give no limitation to the present disclosure. The present disclosure may be embodied in other specific forms without departing from the essential characteristics thereof.

REFERENCE SIGNS LIST

1 Evaporated fuel treatment apparatus
11 Canister
12 Purge passage
13 Purge pump
14 Purge valve
15 ECU
FT Fuel tank
EN Engine
IP Intake passage
THR Throttle valve
AC Air cleaner
AM Air flow meter
BA Battery
IS Idle rotation speed
RS Rated rotation speed
α Predetermined value
β Predetermined value
γ Predetermined value

The invention claimed is:

1. An evaporated fuel treatment apparatus comprising:
a canister configured to store evaporated fuel;
a purge passage connected to an intake passage, which is connected to an internal combustion engine, the purge passage being connected to the canister;
a purge pump provided in the purge passage; and
a purge valve configured to open and close the purge passage, the purge valve being opened while the purge pump is operated to perform a purge control that inputs purge gas containing the evaporated fuel from the canister to the intake passage through the purge passage, the purge control being performed upon satisfying a pre-set purge condition, a first pre-purge condition being satisfied before the purge condition is satisfied, and a second pre-purge condition being satisfied before satisfying the purge condition and after satisfying the first pre purge condition, wherein:
when the first pre-purge condition is satisfied, the purge pump is driven at an idle rotation speed that is lower than a rated rotation speed to execute idle rotation;
when the second pre-purge condition is satisfied, the purge pump is driven at the rated rotation speed to execute rated rotation; and
when the purge condition is satisfied, the purge valve is opened while the rated rotation is executed.

2. The evaporated fuel treatment apparatus according to claim 1, wherein a time period, from when the second pre-purge condition is satisfied to when the purge condition is satisfied, is set to equal to or greater than a time required to increase a rotation speed of the purge pump from the idle rotation speed up to the rated rotation speed.

3. The evaporated fuel treatment apparatus according to claim 1, wherein each condition of the first pre-purge condition, the second pre-purge condition, and the purge condition is set based on a state of charge of a battery mounted in a vehicle.

4. The evaporated fuel treatment apparatus according to claim 1, wherein each condition of the first pre-purge condition, the second pre-purge condition, and the purge condition is set based on operating data of a vehicle.

5. The evaporated fuel treatment apparatus according to claim 1, wherein the purge pump is stopped when a time for executing the idle rotation exceeds a first predetermined time.

6. The evaporated fuel treatment apparatus according to claim 1, wherein:
when the purge condition is not satisfied and when a time for executing the rated rotation exceeds a second predetermined time, the rotation speed of the purge pump is decreased from the rated rotation speed to the idle rotation speed to execute the idle rotation, and when a time for executing the idle rotation exceeds a third predetermined time, the purge pump is stopped from driving.

7. The evaporated fuel treatment apparatus according to claim 2, wherein each condition of the first pre-purge condition, the second pre-purge condition, and the purge condition is set based on a state of charge of a battery mounted in a vehicle.

8. The evaporated fuel treatment apparatus according to claim 2, wherein each condition of the first pre-purge condition, the second pre-purge condition, and the purge condition is set based on operating data of a vehicle.

9. The evaporated fuel treatment apparatus according to claim 3, wherein each condition of the first pre-purge condition, the second pre-purge condition, and the purge condition is set based on operating data of the vehicle.

10. The evaporated fuel treatment apparatus according to claim 7, wherein each condition of the first pre-purge condition, the second pre-purge condition, and the purge condition is set based on operating data of the vehicle.

11. The evaporated fuel treatment apparatus according to claim 2, wherein the purge pump is stopped when a time for executing the idle rotation exceeds a first predetermined time.

12. The evaporated fuel treatment apparatus according to claim 3, wherein the purge pump is stopped when a time for executing the idle rotation exceeds a first predetermined time.

13. The evaporated fuel treatment apparatus according to claim 4, wherein the purge pump is stopped when a time for executing the idle rotation exceeds a first predetermined time.

14. The evaporated fuel treatment apparatus according to claim 7, wherein the purge pump is stopped when a time for executing the idle rotation exceeds a first predetermined time.

15. The evaporated fuel treatment apparatus according to claim 8, wherein the purge pump is stopped when a time for executing the idle rotation exceeds a first predetermined time.

16. The evaporated fuel treatment apparatus according to claim 9, wherein the purge pump is stopped when a time for executing the idle rotation exceeds a first predetermined time.

17. The evaporated fuel treatment apparatus according to claim 10, wherein the purge pump is stopped when a time for executing the idle rotation exceeds a first predetermined time.

18. The evaporated fuel treatment apparatus according to claim 2, wherein:

when the purge condition is not satisfied and when a time for executing the rated rotation exceeds a second predetermined time, the rotation speed of the purge pump is decreased from the rated rotation speed to the idle rotation speed to execute the idle rotation, and then when a time for executing the idle rotation exceeds a third predetermined time, the purge pump is stopped from driving.

19. The evaporated fuel treatment apparatus according to claim 3, wherein:

when the purge condition is not satisfied and when a time for executing the rated rotation exceeds a second predetermined time, the rotation speed of the purge pump is decreased from the rated rotation speed to the idle rotation speed to execute the idle rotation, and then when a time for executing the idle rotation exceeds a third predetermined time, the purge pump is stopped from driving.

20. The evaporated fuel treatment apparatus according to claim 4, wherein:

when the purge condition is not satisfied and when a time for executing the rated rotation exceeds a second predetermined time, the rotation speed of the purge pump is decreased from the rated rotation speed to the idle rotation speed to execute the idle rotation, and then when a time for executing the idle rotation exceeds a third predetermined time, the purge pump is stopped from driving.

* * * * *